US005764255A

United States Patent [19]

Tsurui et al.

[11] Patent Number: 5,764,255

[45] Date of Patent: Jun. 9, 1998

[54] INK JET HEAD WITH A DEFORMABLE PIEZOELECTRIC VIBRATING PLATE

[75] Inventors: Kohji Tsurui, Sakurai; Masaharu Kimura, Daito; Hajime Horinaka, Kashiba, all of Japan

[73] Assignee: Sharp Kabushiki Kaisha, Osaka-fu, Japan

[21] Appl. No.: 385,039

[22] Filed: Feb. 7, 1995

[30] Foreign Application Priority Data

Feb. 8, 1994 [JP] Japan ..... 6-014472

[51] Int. Cl.[6] ..... B41J 2/045

[52] U.S. Cl. ..... 347/70; 347/94

[58] Field of Search ..... 347/70, 68, 69, 347/94, 20

[56] References Cited

U.S. PATENT DOCUMENTS

| | | | |
|---|---|---|---|
| 4,233,610 | 11/1980 | Fischbeck et al. | 347/94 |
| 4,752,788 | 6/1988 | Yasuhara et al. | 347/68 |
| 4,819,014 | 4/1989 | Yasuhara et al. | 347/68 |
| 4,825,227 | 4/1989 | Fishbeck et al. | 347/227 |
| 4,842,493 | 6/1989 | Nilsson et al. | 347/68 X |
| 5,086,308 | 2/1992 | Takahashi et al. | 347/72 |
| 5,124,719 | 6/1992 | Matsuzaki | 347/88 |
| 5,252,994 | 10/1993 | Narita et al. | 347/69 |
| 5,266,964 | 11/1993 | Takahashi et al. | 347/72 |
| 5,410,341 | 4/1995 | Sugahara et al. | 347/69 |
| 5,600,357 | 2/1997 | Usui et al. | 347/94 |

FOREIGN PATENT DOCUMENTS

| | | | |
|---|---|---|---|
| 0600743 | 6/1994 | European Pat. Off. . | |
| 396352 | 4/1991 | Japan | 347/68 |
| 4093370 | 3/1992 | Japan . | |
| 499636 | 3/1992 | Japan | 347/68 |
| 2265113 | 9/1993 | United Kingdom . | |

OTHER PUBLICATIONS

Patent Abstracts of Japan, Dec. 1991, JP-3-284950, (Ricoh Co Ltd).

Patent Abstracts of Japan, Jan. 1992, JP-4-28557, (Fujitsu Ltd).

*Primary Examiner*—Benjamin R. Fuller

*Assistant Examiner*—Charlene Dickens

[57] ABSTRACT

An ink jet head includes an orifice plate having a plurality of orifices disposed transversely at prescribed intervals, a vibrating plate disposed parallel to orifice plate and deformed by applying a potential difference perpendicularly to the direction of polarization, and a plurality of partitions disposed between orifice plate and vibrating plate in the space between adjacent orifices, and the space surrounded by orifice, vibrating plate and partition defines a pressure chamber to be filled with ink. Vibrating plate is provided with a groove having a rectangular cross section in a region having relatively low field intensity when signal voltage is applied. In this structure, the electric capacitance of vibrating plate is reduced without adversely affecting the electric field intensity, and the efficiency of deformation of vibrating plate is increased.

14 Claims, 6 Drawing Sheets

INK JET HEAD WITH A DEFORMABLE PIEZOELECTRIC VIBRATING PLATE

BACKGROUND OF THE INVENTION

1. Field of the Invention

The present invention relates generally to ink jet head structures used for ink jet printers or the like.

2. Description of the Related Art

Now, a description follows on a conventional example of an ink jet head which reduces the volume of a pressure chamber by bending and deforming a piezoelectric body and discharges ink in a pressure chamber from a nozzle.

An exemplary conventional ink jet head of this type has the structure in which an opening surface of a pressure chamber formed on one side of the base body or the main body is covered with a thin vibrating plate and a piezoelectric body is attached to the surface of the vibrating plate at a position corresponding to the pressure chamber. Such a conventional ink jet head is disclosed, for example, in Japanese Patent Laying-Open Nos. 63-57250 and 2-187352.

This conventional ink jet head requires delicate positioning for attaching the piezoelectric body at a prescribed position of the surface of the vibrating plate at a high positioning precision, resulting in the complexity of the manufacturing process.

Another conventional ink jet head which takes advantage of bending and deformation of a piezoelectric body as disclosed in Japanese Patent Laying Open Nos. 3-178445 and 4-115951 has a vibrating plate formed of a piezoelectric element. In this example, the vibrating plate itself is formed of a piezoelectric element, and therefore positioning of the piezoelectric element onto the surface of the vibrating plate as in the first conventional example is not necessary, and therefore the manufacturing process is simplified. In the apparatuses disclosed in these documents, however, potential difference is produced in the same direction as the direction of polarization of the piezoelectric element. Relatively large driving voltage is therefore required for sufficiently deforming the piezoelectric element. In recent years, high resolutions by ink jet printers are in demand, and in addition, the number of nozzles increases as color printing has advanced, resulting in increased power consumption by the printers. Therefore, there has been a need for an ink jet head capable of sufficiently deforming the vibrating plate at low voltage.

Another conventional ink jet head takes advantage of deformation in a shear mode to reduce driving voltage necessary for deformation by providing a piezoelectric body constituting a vibrating plate with potential difference in a direction perpendicular to the direction of polarization. Among such ink jet heads which take advantage of deformation of piezoelectric bodies in the shear mode, some are provided with signal electrodes on both surfaces of a vibrating plate of a piezoelectric body, some with a signal electrode only on one surface of a piezoelectric body, and others use a layered piezoelectric element for a piezoelectric body.

Among such conventional ink jet heads which take advantage of deformation in the shear mode, those with signal electrodes on both surfaces of a vibrating plate have a horizontal cross section taken along the central axis of each orifice as shown in FIG. 6. More specifically, in the conventional ink jet head shown in FIG. 6, a vibrating plate 51 of a piezoelectric body is disposed horizontally to an orifice plate 50 having a plurality of orifices 50*a* and 50*b* at a prescribed pitch. Approximately in the center of the space between adjacent orifices 50*a* and 50*b*, a partition 54 is placed between orifice plate 50 and vibrating plate 51 so as to define a pressure chamber 53 for every orifice.

Signal electrodes 52 are formed on both surfaces of vibrating plate 51 at positions corresponding to each orifice 50*a*, 50*b*. Ground electrodes 55 are formed on both surfaces of vibrating plate 51 at positions corresponding to the position of partition 54.

In the structure of the conventional ink jet head as shown in FIG. 6, signal electrodes 52 are provided on both surfaces of the vibrating plate of a piezoelectric body, an electrode surface positioned in the inner wall of pressure chamber 53 is in direct contact with ink, and therefore conductive ink cannot be used as well as corrosion of the electrodes could result.

In the structure with a signal electrode 52 only on one side of vibrating plate 51 in other words only on a surface opposite to the side facing pressure chamber 53, as illustrated in FIG. 7, applying prescribed signal voltage across signal electrode 52 and ground electrode 55 forms a region 56 with small field intensity in the vicinity of the surface without a signal electrode, which impedes sufficient deformation of vibrating plate 51, and ink discharge efficiency degrades. In particular, as the integration density of nozzles increases, the space between partitions 54 is reduced, the strength of the piezoelectric body forming vibrating plate 51 relatively increases, which impedes vibrating plate 51 from deforming, and ink discharge efficiency degrades, resulting in a great increase of voltage for driving the vibrating plate.

An exemplary conventional ink jet head which uses a layered piezoelectric element for the vibrating plate is disclosed in Japanese Patent Laying-Open No. 4-125157. Referring to FIG. 8, the ink jet printer disclosed in the document has a platen 81 attached rotatably to photoresist 83 by a shaft 82, and platen 81 is driven to rotate by the function of a motor 84. A piezoelectric type ink jet head 85 is provided opposite to platen 81. Ink jet head 85 is placed on a carriage 87 together with an ink supply unit 86. Carriage 87 is slidably supported by two guide rods 88 provided parallel to the axis of platen 81, and is coupled to a timing belt 90 wound around a pair of pulleys 89. One of the pair of pulleys 89 is driven to rotate by the function of motor 91, thus feeding timing belt 90, which in turn drives carriage 87 along platen 81. In the ink jet printer disclosed in the document, an array 92 shown in FIG. 9 is used for ink jet head 85 for the ink jet printer shown in FIG. 8. Referring to FIG. 9, array 92 includes a channel main body 94 in the form of a rectangular container having three ink channels 93*a*, 93*b* and 93*c* opened upwardly, and a layered piezoelectric element 96 fixed to the opening portion of channel main body 94 with adhesive members 95. Ink channels 93*a* to 93*c* each form a pressure chamber to be filled with ink.

Layered piezoelectric element 96 is a stacked structure of a plurality of piezoelectric ceramics layers 97 having a piezoelectric/electrodeforming effect, sets of internal negative electrode layers 98*a*, 98*b*, 98*c*, and 98*d* provided separately corresponding to the positions of adhesive members 95, and sets of internal positive electrode layers 99*a*, 99*b* and 99*c* separately provided corresponding to the central portions of ink channels 93*a* to 93*c*.

The structure of this conventional ink jet head shown in FIG. 9 needs relatively lower driving voltage for deforming vibrating plate 51 for an amount than the structure of the conventional ink jet head shown in FIG. 7. However, the use of the layered piezoelectric element increases the number of electrodes per orifice, interconnection of signal lines for electrodes becomes completed, resulting in increase in the cost.

SUMMARY OF THE INVENTION

It is an object of the present invention to provide an ink jet head which allows for simplification of the manufacturing process and cost reduction by efficiently deforming the vibrating plate at relatively low driving voltage without using a layered piezoelectric element, when the vibrating plate is formed of a piezoelectric body and potential difference is provided in a direction perpendicular to the direction of polarization of the piezoelectric body.

Another object of the present invention is to provide an ink jet head permitting use of conductive ink without providing electrodes of piezoelectric bodies in pressure chambers to be filled with ink, thereby making it possible to obtain sufficient field intensity without corrosion of the electrodes.

An ink jet head according to the present invention which achieves the above-described objects includes an orifice plate having a plurality of orifices transversely disposed at prescribed intervals, a vibrating plate formed of a piezoelectric body which is deformed with potential difference provided in the direction perpendicular to the direction of polarization and a plurality of partitions disposed in the space between the orifice plate and the vibrating plate and between adjacent orifices, with a pressure chamber to be filled with ink being formed in the space surrounded by the orifice plate, the vibrating plate and the partitions. The vibrating plate is provided with grooves in a region having relatively low field intensity when signal voltage is applied.

In this structure, the portion of low field intensity in the vibrating plate is removed by forming the grooves. Accordingly, the portion with virtually no electric field which causes the vibrating plate to be deformed in the shear mode in the piezoelectric body forming the vibrating plate is eliminated, the electric capacitance is reduced as a result, the driving efficiency of the vibrating plate is improved, and power consumption is reduced as well. At the same time, providing the grooves reduces the thickness of the vibrating plate at the positions, and therefore the vibrating plate can be readily bended and deformed with relatively small force.

According to a preferred embodiment of the present invention, grooves are formed on a surface of a vibrating plate facing orifices, signal electrodes are formed corresponding to the grooves on the surface of the vibrating plate opposite to the side facing the orifices, and ground electrodes are formed both on the surface facing the orifices and the opposite surface at positions corresponding to the partitions.

In this structure, since the grooves are formed at the vibrating plate at positions facing the orifices formed in the orifice plate, the vibrating plate at the positions is thinned, and the vibrating plate would be more easily bended and deformed. As a result, ink within the pressure chambers is efficiently discharged from the orifices. In addition, since a signal electrode is not formed on the surface of the vibrating plate facing the orifices, and a ground electrode is formed at the position at which a partition is formed, electrodes for applying voltage across the vibrating plate are not formed at the inner walls of pressure chambers. Accordingly, conductive ink can be used, and electrodes will not be corroded by ink. With ground electrodes being formed on both surfaces of the vibrating plate, substantial field intensity can be provided on the surface of the vibrating plate on the side of the pressure chambers with no signal electrode, and the portions of the piezoelectric body constituting the vibrating plate having lowest field intensity are eliminated by providing the grooves.

In another preferred embodiment of the present invention, grooves are provided on the surface of the vibrating plate opposite to the side facing the orifices, signal electrodes are formed on the internal surfaces of the grooves, and ground electrodes are formed on both the surface of the vibrating plate facing the orifices and the opposite surface at the positions corresponding to the partitions.

In this structure, the grooves are formed on the outer surface of the vibrating plate, the signal electrodes are formed on the inner surfaces of the grooves, and the ground electrodes are formed on both surfaces of the vibrating plate at positions corresponding to the partitions. Accordingly the direction of electric field lies virtually perpendicularly to the direction of polarization of the vibrating plate in the vicinity of the surface of the vibrating plate not facing the orifice plate, and therefore it is easier to cause deformation in the shear mode.

In yet another preferred embodiment of the present invention, grooves are formed at positions corresponding to partitions on the surface of the vibrating plate not-facing the orifices, with ground electrodes being formed at the grooves.

In this structure, the direction of electric field is completely perpendicular to the direction of the polarization on the surface of the vibrating plate not facing the orifice plate, and therefore it is even more easier to cause deformation in-the shear mode.

In a still further preferred embodiment of the present invention, a piezoelectric body forming a vibrating plate is PZT, and ink to fill a pressure chamber is hot-melt ink containing paraffin as a main component together with dye and pigments.

Such ink does not easily sink into the vibrating plate of PZT, and therefore a longer useful life can be provided for the head.

Grooves provided at the vibrating plate in the ink jet head according to the present invention preferably has a rectangular cross section, and signal electrodes are formed on the bottom and both sides of grooves having such a rectangular cross section.

Forming signal electrodes on the bottom and both sides of grooves having a rectangular cross section makes it easier for electric field to be generated in a direction substantially parallel to the vibrating plate between a signal electrode and a ground electrode relatively uniformly along the direction of the thickness of the vibrating plate. Accordingly, an efficient field distribution may be established in order to cause deformation of the vibrating plate in the shear mode, and improvement of ink discharge efficiency results.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described in conjunction with the accompanying drawings.

Figure 1A:
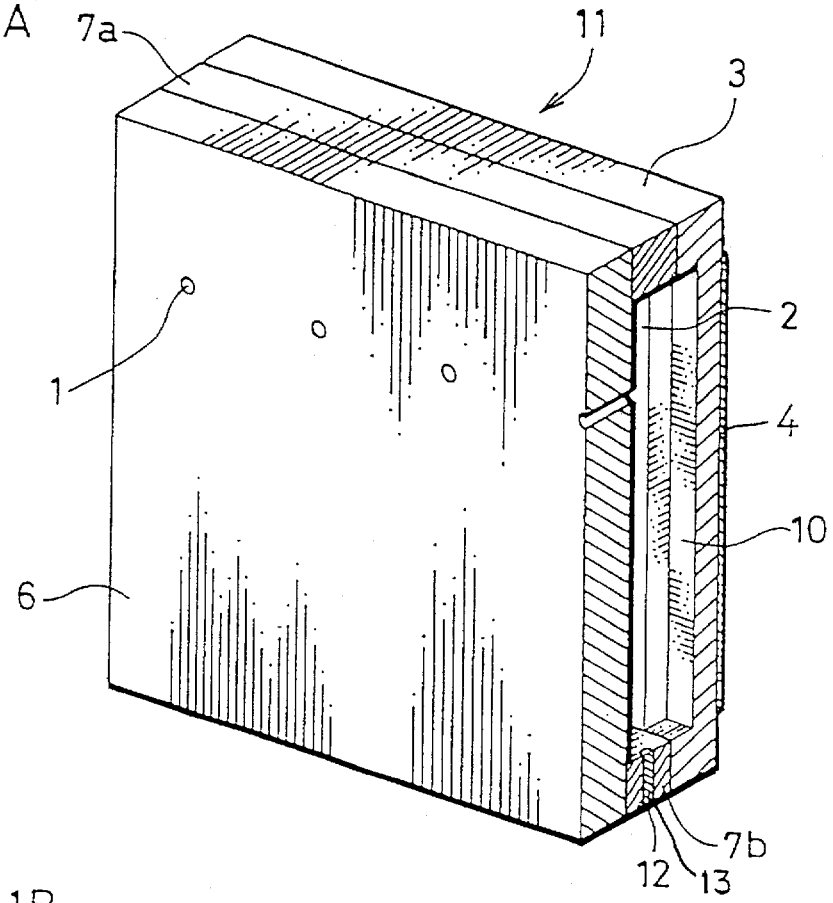
FIG. 1A is a partially cross sectional perspective view showing an ink jet head according to one embodiment of the invention.
Figure 1B:
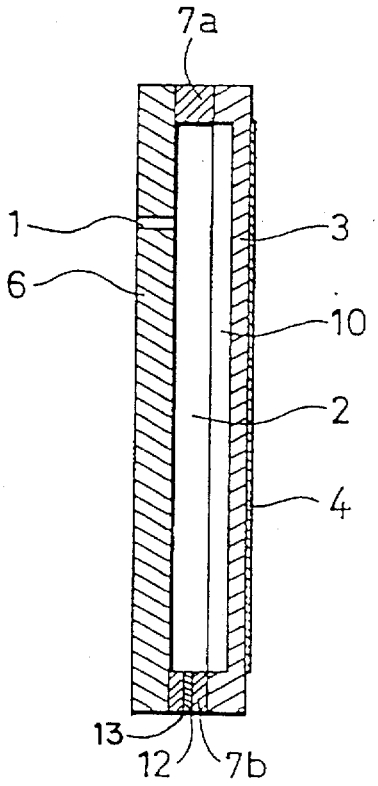
FIG. 1B is a cross sectional view showing the ink jet head taken along a vertical plane including the axis of one orifice.
Figure 2A:
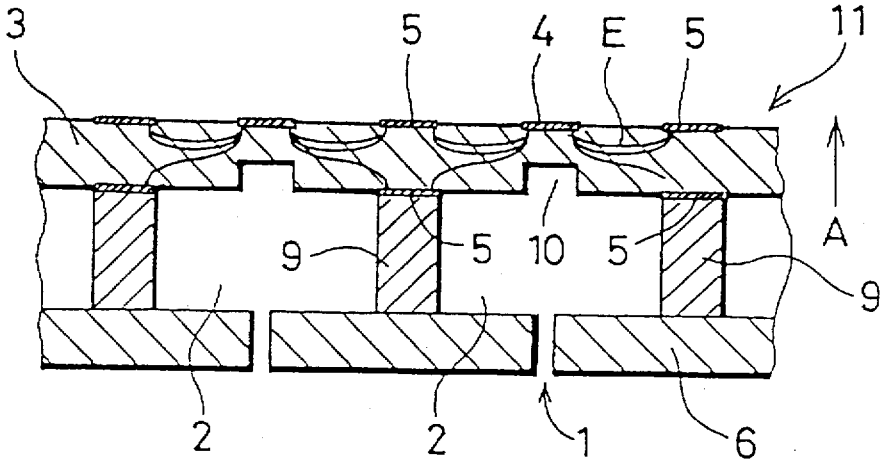
FIG. 2A is a horizontal cross sectional view showing how electric field is generated in the ink jet head shown in FIGS. 1A and 1B.
Figure 2B:
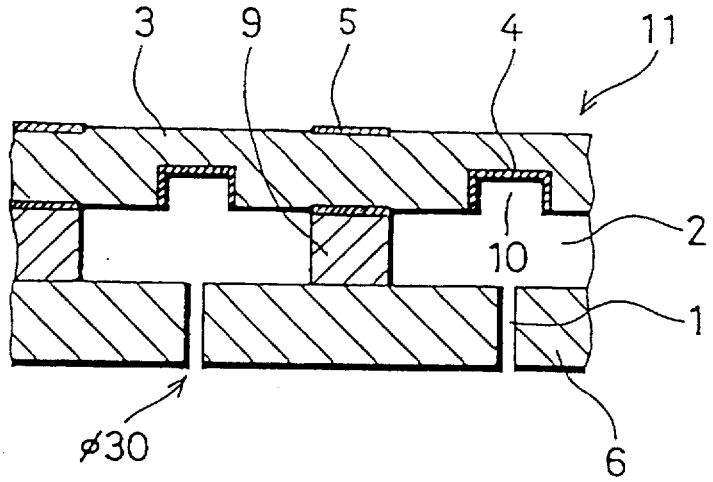
FIG. 2B is a horizontal cross sectional view showing the size of each portion in the ink jet head.
Figure 7:
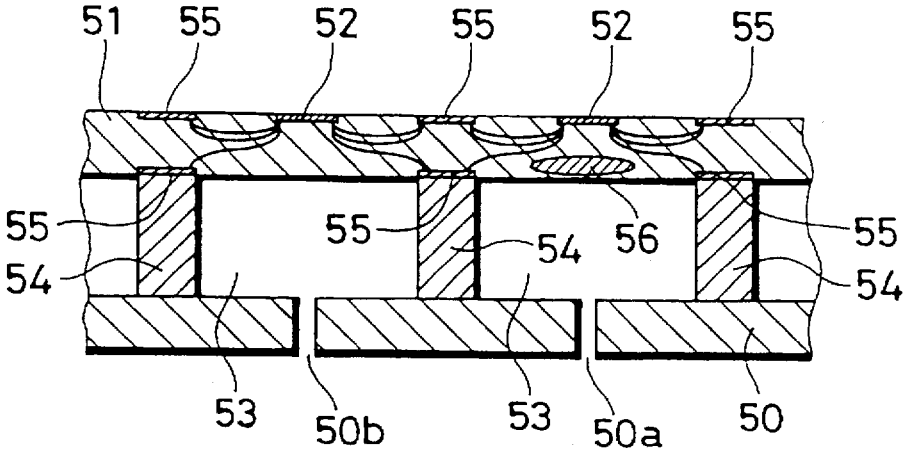
FIG. 7 PRIOR ART
FIG. 7 is a cross sectional view showing another conventional ink jet head.
Figure 8:
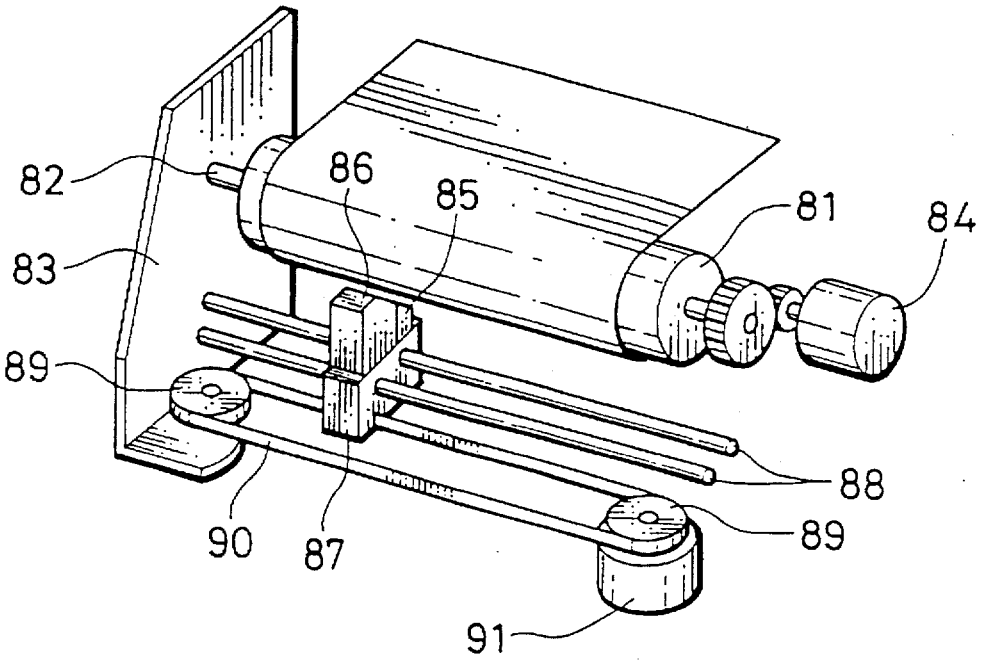
FIG. 8 PRIOR ART
FIG. 8 is a perspective view showing an ink jet printer disclosed in Japanese Patent Laying-Open No. 4-125157.
Figure 9:
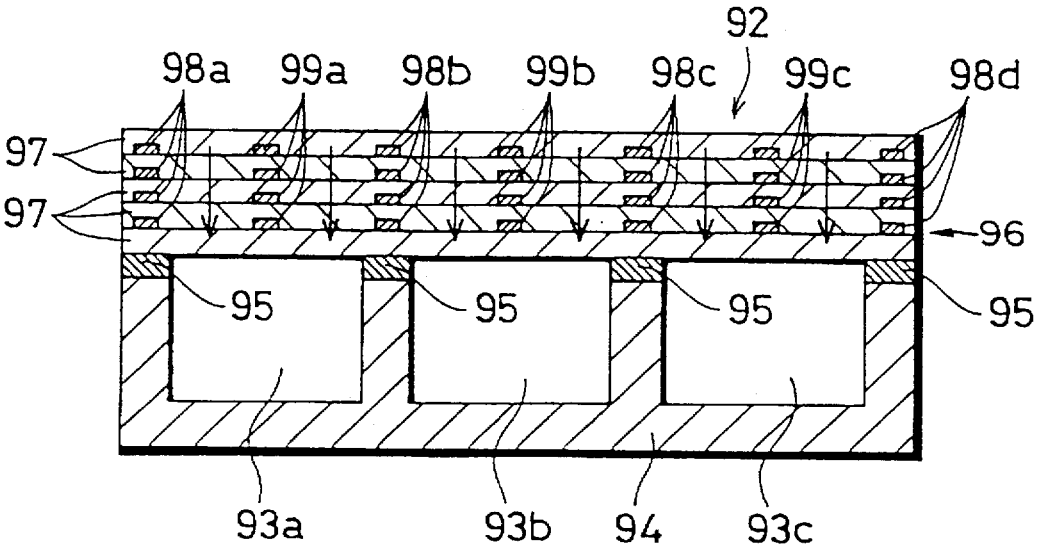
FIG. 9 PRIOR ART
FIG. 9 is a cross sectional view showing an ink jet head disclosed in Japanese Patent Laying-Open No. 4-125157.

FIG. 1A is a perspective view showing an ink jet head according to a first embodiment of the invention taken along a vertical plane including the central axis of one orifice 1, and FIG. 1B is a cross sectional view showing the same ink jet head taken along a vertical surface including one orifice 1. FIGS. 2A and 2B are views showing a plane taken along a horizontal cross section including the central axes of all the orifices 1. Ink jet head 11 according to this embodiment is used as an ink jet head for example in an ink jet printer as disclosed in Japanese Patent Laying-Open No. 4-125157 shown in FIG. 7. The values of the sizes in FIG. 1B are illustrated as examples for the dimension of the present embodiment, where the unit is μm.

Referring to FIGS. 1A and 1B, in ink jet head 11 according to the present embodiment, an orifice plate 6 having a plurality of orifices 1 disposed horizontally at regular intervals and a vibrating plate 3 formed of a piezoelectric body are placed opposite to each other at a prescribed distance apart through a partition 9. The top and bottom of the space between orifice plate 6 and vibrating plate 3 are enclosed by an upper wall plate 7*a* and a lower wall plate 7*b*, and the space defined by orifice plate 6, vibrating plate 3, wall plates 7*a* and 7*b*, and partition 9 constitutes a pressure chamber 2. Elements 7(*a*) and 7(*b*) constitute means for connecting the orifice and vibrating plates at end portions to space them apart.

Each orifice 1 and each pressure chamber 2 constitute one channel, and 50 to 100 channels are arranged at a pitch of about 400 μm, for example.

Partitions 9 are each provided in the middle of the space between adjacent orifices 1, and a pressure chamber 2 is provided for each orifice 1. Formed in lower wall plate 7*b* is an ink introducing hole 12 corresponding to orifice 1, through which ink is filled within pressure chamber 2. A groove 10 is formed on the inner side surface of vibrating plate 3 facing orifice plate 6 at a position opposite to orifice 1, and a signal electrode 4 is formed on the outer surface of vibrating plate 3 opposite to the inner surface facing orifice plate 6 at a position corresponding to groove 10. Ground electrodes 5 are formed on both inner and outer surfaces of vibrating plate 3 at positions corresponding to partitions 9.

Lower wall plate 7*b* is provided with an ink supply hole 12 having a diameter of about 25 μm for every channel, and a filter is attached within ink supply hole 12. Ink supplied into pressure chamber 2 via ink supply hole 12 from an ink supply unit is removed of impurities contained therein by the filter 13 within ink supply hole 12.

Groove 10 is formed by precision machine-cutting. Signal electrode 4 and ground electrode 5 are formed of a material such as gold having a thickness about in the range from 1 to 3 μm, and formed by subjecting vibrating plate 3 to a known sputtering process.

Application of driving voltage on signal electrode 4 in ink jet head 11 as described above generates electric field E from signal electrode 4 to ground electrode 5 within vibrating plate 3. The direction of electric field E lies in a direction virtually perpendicular to the direction of polarization of vibrating plate 3 indicated by arrow A in FIG. 2, and vibrating plate 3 formed of a piezoelectric body is deformed in the shear mode. FIG. 2B shows the dimensions of the ink jet head according to the present embodiment by way of illustration, where the unit of each value is μm.

Figure 3A:
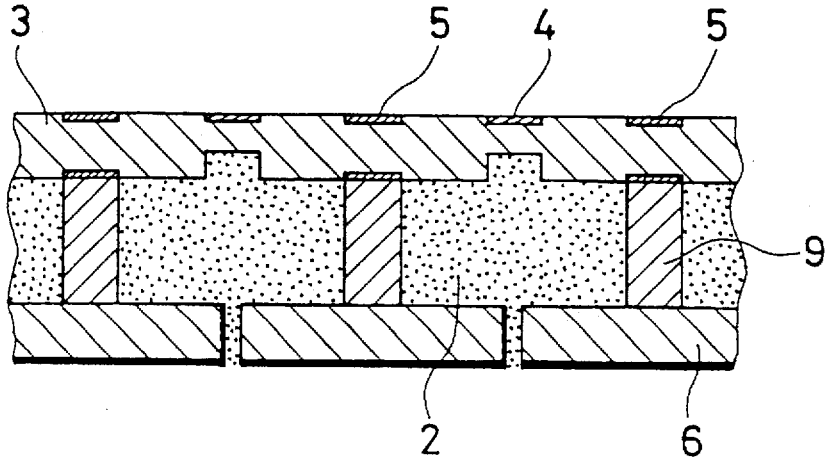
FIGS. 3A, 3B and 3C are cross sectional views sequentially showing how ink is discharged in the ink jet head shown in FIGS. 1A and 1B.
Figure 3B:
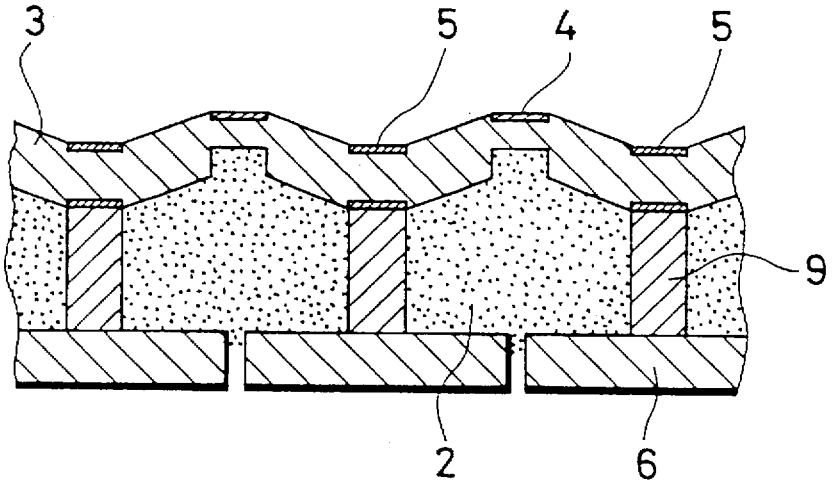
Figure 3C:
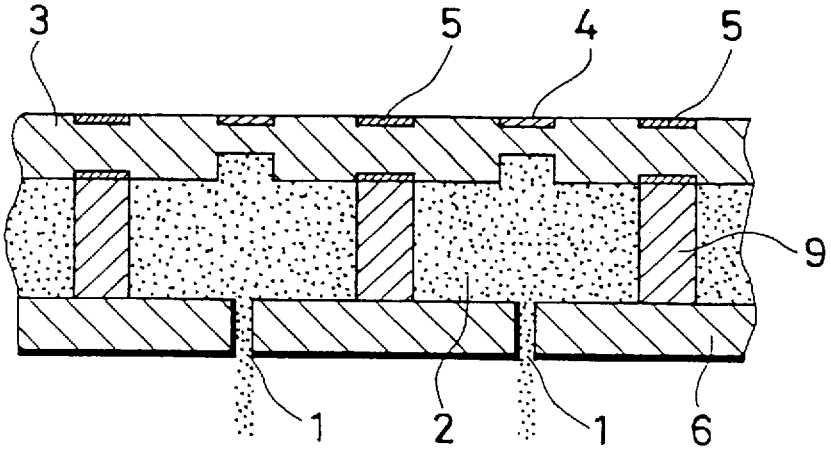

Ink discharging operation by the deformation of vibrating plate 3 in ink jet head 11 will be now described in conjunction with FIGS. 3A to 3C.

As illustrated in FIG. 3A, applying driving voltage on signal electrode 4 with each pressure chamber 2 filled with ink, electric field is formed from signal electrode 4 to ground electrode 5 and vibrating plate 3 formed of the piezoelectric body is caused to bend and deformed in the shear mode as illustrated in 3B, and the volume of pressure chamber 2 is expanded. Thereafter, signal electrode 4 is grounded for discharge, and then as illustrated in FIG. 3C, vibrating plate 3 returns to the original flat-plate-shape. The reduction of the volume of pressure chamber 2 in this returning operation causes ink in pressure chamber 2 to be discharged from orifice 1.

Since vibrating plate 3 in ink jet head 11 as described above is formed of a ferroelectric piezoelectric body, signal electrode 4, ground electrode 5 and vibrating plate 3 act as a capacitor, and the larger the electric capacitance of the capacitor is, the smaller will be electric field intensity within vibrating plate 3 for fixed voltage applied across the region between signal electrode 4 and ground electrode 5. In ink jet head 11 according to this embodiment, as can be clearly seen from FIG. 2, groove 10 is formed in vibrating plate 3 at the portion with small field intensity, in other words the portion which hardly contributes to the deformation of vibrating plate 3 in view of field intensity is removed. Accordingly, the dielectric constant of the portion is reduced, and the electric capacitance of the capacitor constituted by signal electrode 4, ground electrode 5 and vibrating plate 3 is reduced as a result. Thus forming groove 10 hardly adversely affects the electric field intensity used for deforming vibrating plate 3, and conversely the field intensity can be relatively increased rather if prescribed driving voltage is applied across the region between signal electrode 4 and ground electrode 5.

Thus, forming groove 10 removes the portion with too small a field intensity to cause vibrating plate 3 to be deformed, and therefore electric capacitance can be reduced without reducing the efficiency of deformation of vibrating plate 3. As a result for fixed driving voltage applied on signal electrode 4, reduced charge is stored in each channel in vibrating plate 3, resulting in reduced power consumption. As for the amount of deformation of vibrating plate 3 in the shear mode, since the portion of vibrating plate 3 positioned in the middle of the space between adjacent partitions 9 is thinned by forming groove 10, vibrating plate 3 bends more easily, and sufficient deformation can be achieved at low application voltage.

As described above, according to the structure of the ink jet head of the present embodiment, forming groove 10 reduces charge introduced to each channel in vibrating plate 3, bending and deforming can be achieved more easily at the same time, and therefore power consumption for driving the ink jet head can be greatly reduced.

Figure 4:
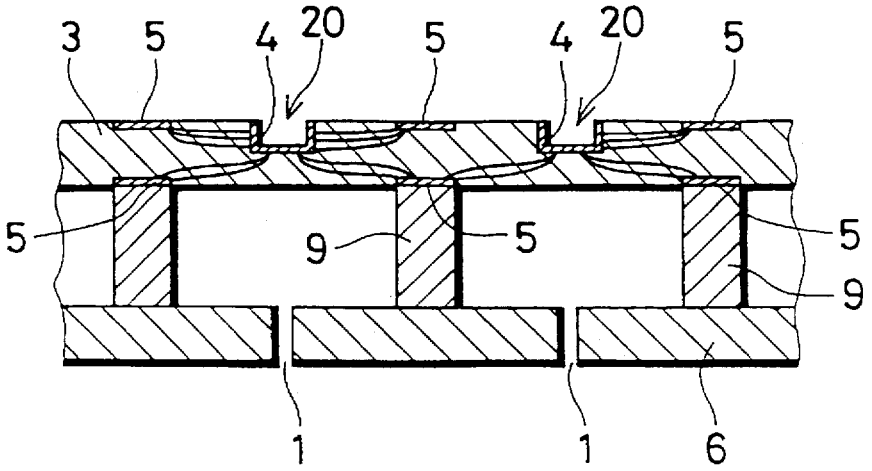
FIG. 4 is a cross sectional view showing an ink jet head according to a second embodiment of the invention.

The structure of an ink jet head according to a second embodiment of the invention will be now described in conjunction with FIG. 4. Note that in FIG. 4 the same or corresponding elements to the ink jet head according to the first embodiment shown in FIG. 2 are designated with the same reference characters, and a detailed description thereof will not be provided.

In this embodiment, referring to FIG. 4, a groove 20 having a rectangular cross section is formed on an outer surface of the vibrating plate 3 of the ink jet head at a position corresponding to each orifice 1. Groove 20 has a signal electrode 4 formed by sputtering on its bottom and both side surfaces. Ground electrodes 5 are formed at positions corresponding to partition 9 on vibrating plate 3 on the side of orifice plate 6 and the opposite side. Having such a structure, the ink jet head of this embodiment has groove 20 formed on the outer surface of vibrating plate 3 and signal electrode 4 on the inner wall surface of groove 20, and therefore electric field generated between signal electrode 4 formed on the sidewall of groove 20 and ground electrode 5 formed on the outer surface of vibrating plate 3 can be directed perpendicularly to the direction of polarization of vibrating plate 3, in other words the thickness-wise direction. As a result, the direction of electric field in the vicinity of the outer surface of vibrating plate 3 can be directed more perpendicularly to the direction of polarization of vibrating plate 3. In addition, since sufficient electric field is generated also with ground electrodes 5 formed on the inner surface of vibrating plate 3, sufficient electric field intensity can be provided in the vicinity of the inner surface of vibrating plate 3. As a result, the efficiency of deformation of vibrating plate 3, in other words, the degree of deformation of vibrating plate 3 at prescribed driving voltage applied on signal electrode 4 can be increased.

Figure 5:
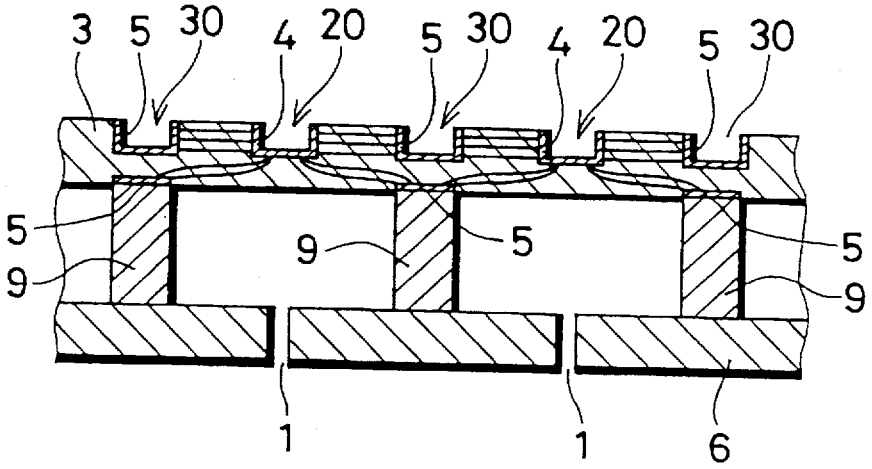
FIG. 5 is a cross sectional view showing an ink jet head according to a third embodiment of the invention.
Figure 6:
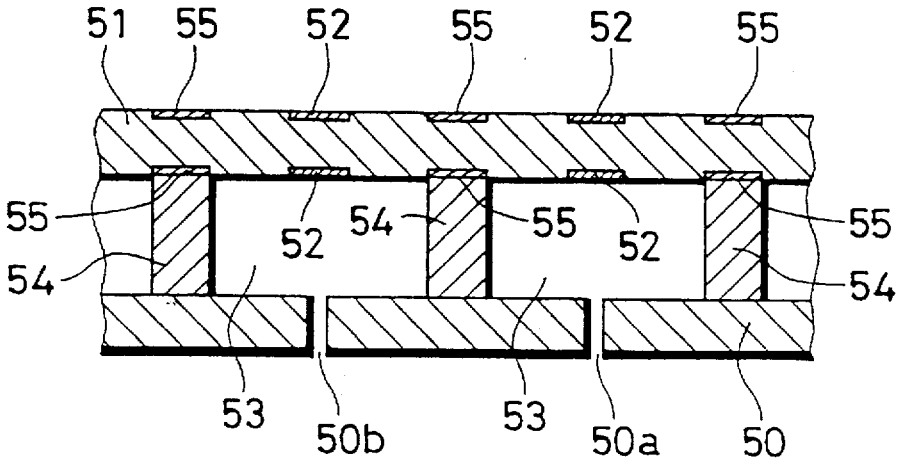
FIG. 6 PRIOR ART
FIG. 6 is a cross sectional view showing an exemplary conventional ink jet head.

A third embodiment of the invention will be now described in conjunction with FIG. 5. Note that in FIG. 5, the same elements as or corresponding elements to the ink jet head according to the first embodiment described above are designated with the same reference characters, and a detailed description thereof will not be provided.

In the ink jet head of this embodiment, groove 20 is formed on the outer surface of vibrating plate 2 at a position corresponding to each orifice 1 as is the case with the second embodiment described above, with signal electrode 4 being formed on the inner wall surface thereof. In this embodiment, a groove 30 having a rectangular cross section is formed on the outer surface of vibrating plate 3 at a position corresponding to the position of each partition 9, and ground electrode 5 is formed on the bottom and both sidewall surfaces of the inner wall surface. Ground electrode 5 is also formed on the inner surface of vibrating plate 3 at a position corresponding to the position of each partition 9 as is the case with the first and second embodiments.

Thus forming grooves 20 and 30 on the outer surface of vibrating plate 3 and forming signal electrode 4 and ground electrodes 5 on the respective inner sidewall surfaces makes it possible to direct electric field generated between signal electrode 4 formed on the sidewall of groove 20 and ground electrode 5 formed on the sidewall of groove 30 virtually completely perpendicularly to the direction of polarization of vibrating plate 3, in other words perpendicularly to the thickness-wise direction, and the effect of directing the electric field in the vicinity of the outer surface of vibrating plate 3 perpendicularly to the direction of polarization of vibrating plate 3 is even more enhanced than the second embodiment. Thus newly forming groove 30 hardly adversely affects field effect intensity, and therefore the piezoelectric body constituting vibrating plate 3 is reduced by forming such groove 30, resulting in even more reduced electric capacitance. Accordingly, the deformation efficiency of vibrating plate 3 can be greatly improved.

Note that ink applied for the ink jet head in the above embodiments is preferably hot-melt ink containing paraffin as an essential component together with dye or pigment. This is because the ink is not likely to sink into vibrating plate 3 if PZT is used for the piezoelectric body constituting vibrating plate 3, and the useful life of the ink jet head can be prolonged as a result.

Note that the above embodiments of the present invention have been described simply as examples and various forms can be employed without departing from the gist of the present invention.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An ink jet head, comprising:

an orifice plate having a plurality of orifices disposed transversely at prescribed intervals;

a vibrating plate having a first surface and a second surface with ground electrodes formed on said first surface and said second surface, the vibrating plate disposed parallel to said orifice plate and formed of a deformable piezoelectric body;

means for connecting end portions of the orifice plate and vibrating plate, so that over a linear distance between said orifice plate and vibrating plate, the orifice plate and vibrating plate are spaced apart;

a plurality of partitions disposed between said orifice plate and said vibrating plate each one of the plurality of partitions is located between adjacent orifices, end portions of said each one of said plurality of partitions contacting one of the ground electrodes on said first surface, a pressure chamber for containing ink, being formed in a space surrounded by said orifice plate, said vibrating plate and said partitions, wherein an open groove is provided on the first surface of said vibrating plate, the open groove directly facing one of the orifices, a signal electrode is formed on the second surface of said vibrating plate opposite to the first surface at a location corresponding to a location of said open groove, and the ground electrodes formed on said second surface of said vibrating plate are at locations corresponding to specific locations where said end portions of said partitions contact the ground electrodes on said first surface, so that the open groove is located in a region having low field intensity when a signal voltage is applied to the signal electrode.

2. An ink jet head as recited in claim 1, wherein said groove has a rectangular cross section, and said signal electrode is formed entirely on bottom and side surfaces of said groove.

3. An ink jet head as recited in claim 1, wherein said pressure chamber has top and bottom ends enclosed by an upper wall plate and a lower wall plate, respectively, and an ink supply hole having a filter located at said lower wall plate.

4. An ink jet head comprising:

an orifice plate having a plurality of orifices disposed transversely at prescribed intervals;

a vibrating plate having a first surface and a second surface with ground electrodes formed on said first surface and said second surface, the vibrating plate disposed parallel to said orifice plate and formed of a piezoelectric body having a direction of polarization, said piezoelectric body deformable by means for applying a potential difference in a direction perpendicular to the direction of polarization;

means for connecting end portions of the orifice plate and vibrating plate, so that over a linear distance between said orifice plate and vibrating plate, the orifice plate and vibrating plate are spaced apart;

a plurality of partitions disposed between said orifice plate and said vibrating plate, each one of the plurality of partitions are located between adjacent orifices, said each one of said partitions contacting one ground electrode on said first surface of the vibrating plate;

a pressure chamber for containing ink being formed in a space surrounded by said orifice plate, said vibrating plate and said partitions;

wherein said vibrating plate first surface faces said orifices and the second surface is opposite the first surface, and said second surface includes a first open groove having an inner wall surface, where said first open groove is directly opposite one of the orifices a signal electrode is formed on the inner wall surface of said first open groove, and the ground electrodes formed on said second surface of said vibrating plate corresponding to the specific locations where said partitions contact ground electrodes on said first surface, and a second open groove is formed on the second surface of said vibrating plate at a location adjacent to the location of said partitions, with a ground electrode formed in said second open groove.

5. An ink jet head as recited in claim 4, wherein said groove formed in said vibrating plate has a rectangular cross section, and said signal electrode is formed entirely on bottom and side surfaces of said groove.

6. An ink jet head recited in claim 4, wherein said first open groove has a rectangular cross section and the inner wall surface includes a bottom surface and two spaced apart side surfaces that are substantially perpendicular to the bottom surface with said signal electrode being formed entirely on the bottom surface and the side surfaces, said second open groove has a rectangular cross section defined by a bottom surface and two spaced apart side surfaces that are substantially perpendicular to the bottom surface with said ground electrode being formed entirely on the bottom surface and side surfaces.

7. The ink jet structure of claim 6, wherein the portions of the signal electrode formed on the side surfaces have an open space between the portions.

8. An ink jet head, comprising:

an orifice plate having a plurality of orifices disposed transversely at prescribed intervals;

a vibrating plate having a first surface and a second surface with ground electrodes on said first surface, said vibrating plate disposed parallel to said orifice plate and formed of a deformable piezoelectric body; and means for connecting end portions of the orifice plate and vibrating plate, so that over a distance between said orifice plate and vibrating plate the orifice plate and vibrating plate are spaced part;

a plurality of partitions disposed between said orifice plate and said vibrating plate in a space between adjacent orifices, each one of said partitions contacting one of the ground electrodes on the first surface of the vibrating plate, a pressure chamber for containing ink being formed in the space surrounded by said orifice plate, said vibrating plate and said partitions, wherein an open groove having a rectangular cross section is provided for each one of said plurality of orifices on the first surface of said vibrating plate each said open groove directly facing a different one of said orifices, a signal electrode is directly formed on the second surface of said vibrating plate opposite to the first surface at a position corresponding to a position of said open groove, and ground electrodes formed on the second surface of said vibrating plate at locations corresponding to locations, where said partitions contact the ground electrodes on the first surface of the vibrating plate.

9. An jet head as recited in claim 8, wherein said signal electrode is formed entirely on bottom and side surfaces of said groove.

10. An ink jet head as recited in claim 8, wherein the piezoelectric body forming said vibrating plate is PZT, and the ink is a hot-melt ink containing paraffin and dye or pigment.

11. An ink jet head, comprising:

an orifice plate having a plurality of orifices disposed transversely at prescribed intervals with a space between adjacent orifices;

a vibrating plate having first surface and a second surfaces each one of said first surface and said second surface having spaced ground electrodes, said vibrating plate disposed parallel to said orifice plate with the first surface directly facing the orifices and formed of a piezoelectric body having a direction of polarization, said piezoelectric body deformable by means for applying a potential difference perpendicularly to the direction of polarization;

means for connecting end portions of the orifice plate and vibrating plate, so that over a linear distance between said orifice plate and vibrating plate, the orifice plate and vibrating plate are spaced apart;

a plurality of partitions disposed between said orifice plate and said vibrating plate in the space between adjacent said orifices, each one of said partitions contacting a ground electrode on the first surface the vibrating plate at specific locations;

a pressure chamber for containing ink being formed in a space defined by said orifice plate, said vibrating plate and said partitions, wherein a first open groove with an inner side wall, having a rectangular cross section is provided for every one of said orifices on the second surface of said vibrating plate which is opposite to the first surface, each said open groove facing directly opposite a different one of said orifices, a signal electrode is formed on the inner side wall surface of said first open groove, and the ground electrodes formed on the second surface of said vibrating plate at a location corresponding to locations where said partition contacts the ground electrodes on said vibrating plate, and a second groove open is provided on the second surface of said vibrating plate at a location corresponding to the specific location where said partitions contact the ground electrodes on the first surface of said vibrating plate, and a ground electrode is formed in said second open groove.

12. An ink jet head as recited in claim 11, wherein said signal electrode is formed entirely on bottom and side surfaces of said groove.

13. An ink jet head as recited in claim 11, wherein said signal electrode is formed entirely on a bottom and side surfaces of said first groove, and said ground electrode is formed entirely on a bottom and side surfaces of said second groove.

14. An ink jet head as recited in claim 11, wherein the piezoelectric body forming said vibrating plate is PZT, and wherein the ink is a hot-melt ink containing paraffin and dye or pigment.

* * * * *